US010725429B2

(12) United States Patent
Loetscher et al.

(10) Patent No.: US 10,725,429 B2
(45) Date of Patent: Jul. 28, 2020

(54) TIMEPIECE CONTAINING A LOCKING DEVICE FOR A PUSHER

(71) Applicant: Omega SA, Biel/Bienne (CH)

(72) Inventors: Philippe Loetscher, Evilard (CH); Gregory Kissling, Macolin (CH)

(73) Assignee: Omega SA, Biel/Bienne (CH)

( * ) Notice: Subject to any disclaimer, the term of this patent is extended or adjusted under 35 U.S.C. 154(b) by 169 days.

(21) Appl. No.: 15/972,280

(22) Filed: May 7, 2018

(65) Prior Publication Data

US 2018/0341228 A1 Nov. 29, 2018

(30) Foreign Application Priority Data

May 24, 2017 (EP) ..... 17172883

(51) Int. Cl.
*G04B 37/00* (2006.01)
*G04B 3/04* (2006.01)
(Continued)

(52) U.S. Cl.
CPC ..... *G04B 37/0091* (2013.01); *G04B 3/043* (2013.01); *G04B 3/045* (2013.01);
(Continued)

(58) Field of Classification Search
CPC .... G04B 37/0091; G04B 3/043; G04B 3/045; G04B 3/048; G04B 19/18; G04B 37/0008;
(Continued)

(56) References Cited

U.S. PATENT DOCUMENTS 3,548,588 A * 12/1970 Piquerez ..... G04B 19/166 368/294
5,742,565 A * 4/1998 Cuinet ..... G04B 19/283 368/190
(Continued)

FOREIGN PATENT DOCUMENTS

| | | |
|---|---|---|
| CH | 504 044 | 11/1970 |
| CH | 700 535 A1 | 9/2010 |
| EP | 1 582 945 A2 | 10/2005 |

OTHER PUBLICATIONS

European Search Report dated Nov. 1, 2017 in European Application 17172883.5 filed on May 24, 2017 (with English Translation of Categories of Cited Documents and Written Opinion).

*Primary Examiner* — Edwin A. Leon
(74) *Attorney, Agent, or Firm* — Oblon, McClelland, Maier & Neustadt, L.L.P.

(57) ABSTRACT

A timepiece is equipped with a case that includes a case middle, a pusher, and a locking device for this pusher. The pusher is arranged movably in a translational manner in an actuation axis. The locking device contains a blocker that is movable in a translational manner along the actuation axis and with the ability to be displaced between a locking position and an unlocking position, in which positions the pusher is respectively to the locking and unlocking positions blocked and free in translation. The locking device contains in addition a control rotatably mounted in a general plane of the case between a first position and a second position corresponding respectively to the locking and unlocking positions for the blocker, this control containing structure for driving the blocker between its locking and unlocking positions.

16 Claims, 4 Drawing Sheets

(51) Int. Cl.

| | |
|---|---|
| ***G04B 37/10*** | (2006.01) |
| ***G04B 47/06*** | (2006.01) |
| ***G04F 7/08*** | (2006.01) |
| ***G04B 19/18*** | (2006.01) |

(52) U.S. Cl.
CPC ..... *G04B 3/048* (2013.01); *G04B 19/18* (2013.01); *G04B 37/0008* (2013.01); *G04B 37/106* (2013.01); *G04B 47/066* (2013.01); *G04F 7/0866* (2013.01)

(58) Field of Classification Search
CPC .. G04B 37/106; G04B 47/066; G04B 19/286; G04F 7/0866; G04C 3/001
USPC ..... 368/297
See application file for complete search history.

(56) References Cited

U.S. PATENT DOCUMENTS

| | | | | |
|---|---|---|---|---|
| 6,872,899 | B2 * | 3/2005 | Oshio ..... | G04B 37/106 200/341 |
| 7,434,984 | B2 * | 10/2008 | Hiranuma ..... | G04B 19/286 368/295 |
| 7,494,270 | B2 * | 2/2009 | Hiranuma ..... | G04B 3/043 368/288 |
| 2005/0254353 | A1 | 11/2005 | Cogoli et al. | |
| 2010/0142333 | A1 | 6/2010 | Hiranuma et al. | |

* cited by examiner

TIMEPIECE CONTAINING A LOCKING DEVICE FOR A PUSHER

This application claims priority from European Patent Application No. 17172883.5 filed on May 24, 2017; the entire disclosure of which is incorporated herein by reference

TECHNICAL FIELD

The present invention relates to the field of watchmaking. It concerns more specifically a timepiece containing a locking device for a pusher that is capable of actuation by a user of the timepiece, in particular a push-button.

PRIOR ART

The production of timepieces containing a locking device which permits a push-button to be rendered inactive is familiar. The purpose of these devices is to prevent the accidental actuation of the push-button or, in the case of diver's watches, to avoid the actuation of the push-button under the effect of the external pressure.

Numerous patent applications describing a suchlike locking device are known. For example, application CH678138 proposes a screwed pusher which may be immobilized by a threaded ring that is coaxial with the pusher. The threaded ring is screwed onto the pendant of the pusher and may provide support under the head of the pusher in order to prevent its actuation. Application U.S. Pat. No. 9,105,413 describes a variant of this device.

Application CH707595 proposes a watch pusher that is capable of being blocked with the help of a rotating ring that is coaxial with the pusher, and of which the rotation causes the axial displacement of a sleeve with the ability to provide support under the head of the pusher.

These locking devices exhibit a plurality of disadvantages, however. Since the pusher is surrounded by a coaxial control ring which must be capable of being rotated by a user and must therefore extend sufficiently radially beyond the peripheral surface of the case middle of the watch case, this pusher must be protruding while also having a short travel, which makes its actuation more difficult and less precise. In order for the travel of the pusher to be elongated in such a way as to exhibit a usual length, the rod of the pusher must be elongated in such a way that the head of the pusher is then relatively remote from the case middle, which changes the aesthetics of the watch adversely. In fact, the control ring must exhibit a certain height beyond the case middle and a certain diameter, normally greater than that of the head of the pusher, in order for it to be easily manipulated. As a result, the push-buttons that are equipped with a suchlike locking device have a solid appearance. Furthermore, the screw thread utilised to transform the rotational movement into translational movement must be sufficiently small for the transformation not to be reversible in an accidental manner, that is to say any friction must be sufficient to withstand unintentional unscrewing. A long manipulation period, due to the large number of rotations of the control ring, is therefore necessary in order to switch the device between its locked and unlocked states. For watches containing a plurality of pushers, as is generally the case for those equipped with a chronograph, the locking operation may thus prove to be particularly time-consuming, since it must be performed successively for each of the pushers.

Pusher locking devices which in part offer a solution to the above-mentioned problem are also known. Document US 2010/014233 thus proposes to block the actuation of a pusher by a vertically mobile framework, in a manner perpendicular to the actuation axis of the pusher. This framework defines an upper abutment for the pusher, which is positioned behind the head of the pusher depending on the position of a rotating bezel which serves as a control means for the locking device. The framework and thus the abutment are arranged beneath the rotating bezel in order to be capable of being actuated directly by a lower surface of this rotating bezel. This embodiment possesses a first disadvantage due to the fact that the rear part of the head of the pusher must be inserted into the case of the watch when the pusher is in its rest position (pusher not actuated). A second disadvantage derives from the fact that the pusher is locked by a small abutment acting solely against the upper part of the head of the pusher. A third disadvantage arises from the fact that the locking device is cumbersome, in particular the framework which moves vertically in the case middle, which case middle must exhibit a recess for this purpose. Furthermore, the vertical movement of the framework requires a relatively tall case to permit this movement in the interior of this case.

Also familiar from document EP 1 582 945, FIGS. 7, 8 and 11, is a locking device for a pusher in which a tube and a piston passing through this tube are integral with the head of the pusher, the tube being fixed to this head and the piston being movably arranged in the tube between two vertical positions, that is to say between two positions in an axis perpendicular to the actuation axis of the pusher. A rotating bezel has a groove in its lower surface, one extremity of the piston being housed in this groove. This groove has a portion (45) with a depth which varies in such a way as to permit the actuation of the piston in the tube between two extreme positions which define respectively a locking position and an unlocking position of the pusher. This embodiment with small component parts that are difficult to assemble is complicated. Since the tube and the piston are integral with the pusher during displacement in the actuation axis, it is necessary to provide a relatively large radial recess in the bezel and in the top of the case middle, such that the piston and its tube may be displaced radially with the pusher into the unlocking position. The system is therefore cumbersome. This is made even worse by the fact that the piston describes a vertical movement in order to lock the pusher, which requires a relatively large height of the case above the pusher. The incorporation of the pusher with the piston into the case is difficult, furthermore. In fact, the rotating bezel and the fixed bezel must be mounted after having introduced the pusher equipped with its locking device, while making sure to maintain the piston in the intended vertical orientation. In particular, the pusher itself must be assembled before or simultaneously with the two above-mentioned bezels, and it is not possible to change it subsequently without dismantling them beforehand. In conclusion, it can be seen that this embodiment of the prior art exhibits a plurality of disadvantages.

SUMMARY OF THE INVENTION

The aim of the present invention is to address the various disadvantages of the prior art by proposing a timepiece equipped with a locking device for at least one pusher which is less cumbersome, more discreet and easier to use.

For this purpose, the present invention concerns a timepiece containing a case, a pusher mounted in a case middle of the case and a locking device adapted to lock the pusher, this pusher being arranged in such a way as to be capable of undergoing a translation in an axis of actuation of the pusher by a user. The locking device contains a blocking means and a control means arranged to control the displacement of the blocking means between a locking position and an unlocking position, in which positions the pusher is respectively blocked and free in translation. The control means extends in a general plane parallel to said actuation axis and is arranged movably in this general plane between a first position and a second position which correspond respectively to the locking and unlocking positions for the blocking means driven by the control means. According to the invention, the blocking means is arranged movably in a translational manner along the actuation axis and with the ability to be displaced by the control means along this actuation axis between the locking position, where it forms an axial abutment for the pusher, and the unlocking position set back from the locking position. The control means contains for this purpose means for driving the blocking means in the actuation axis.

According to an advantageous embodiment, the timepiece contains a bezel and the control means is formed by an intermediate ring mounted between the case middle and the bezel, this ring being rotatably mounted about an axis substantially perpendicular to the actuation axis.

According to another advantageous embodiment, the timepiece contains a rotating bezel forming the control means.

According to a preferred embodiment, the blocking means is a cylindrical sleeve surrounding the pusher and arranged movably in the actuation axis of the pusher.

According to one particular embodiment, the blocking means is a slider arranged movably in the actuation axis of the pusher.

According to another advantageous embodiment, the pusher contains a head and the blocking means is adapted to be positioned, in order to lock it, at a short distance from this head or bearing against the latter.

According to another advantageous embodiment, the control means has a cam for the radial positioning of the blocking means cooperating with a follower means that this blocking means contains.

According to an advantageous variant, the timepiece contains an elastic return means seeking to maintain the follower means in contact with the cam.

According to another advantageous variant, the cam is formed by a groove, and the follower means is a pin inserted into this groove.

According to one particular variant, the cam is formed by a rib/a rail protruding beneath the control means, and the follower means is a slot machined into the blocking means.

According to another advantageous variant, the locking device contains a visual means facilitating the recognition of the position of the blocking means.

According to another advantageous variant, the locking device contains a means of positioning intended to maintain the control means in place in its first and second positions, which thus define two stable positions.

According to one particular variant, each of the first and second positions of the control means is assured by a pressure point, for example formed by a ball mounted on an elastic element.

BRIEF DESCRIPTION OF THE FIGURES

Other details of the invention will emerge from a perusal of the following description, which is made with reference to the accompanying drawings, in which:

FIGS. 5 to 9 represent various cross-sections of a second embodiment of a timepiece according to the invention, FIGS. 5 and 7 depicting the locking device in the locking position, whereas FIGS. 6 and 9 depict it in the unlocking position and FIG. 8 in an intermediate position.

DETAILED DESCRIPTION

Figure 1:
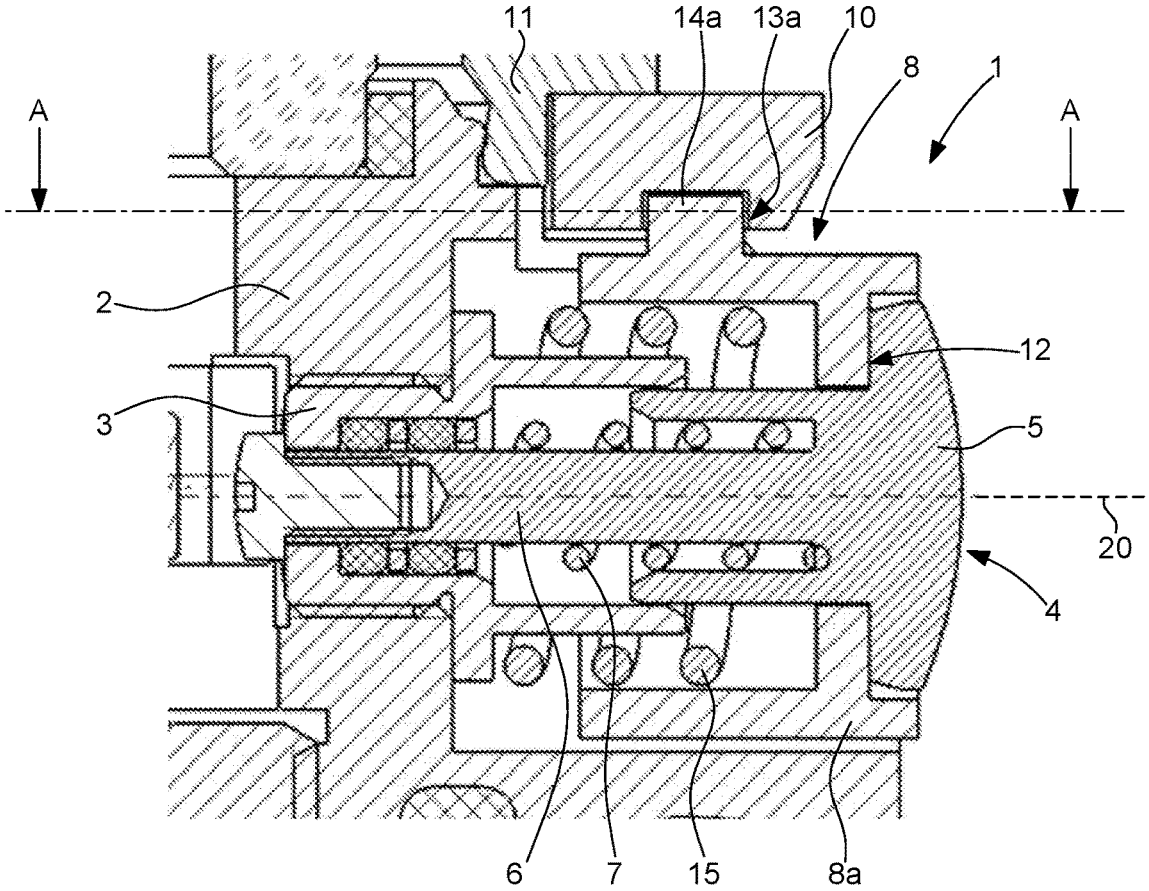
FIGS. 1 and 2 represent a view in transverse section and a cross-sectional view according to the line A-A of a first embodiment of a timepiece according to the invention, in which the locking device is in its locking position.
Figure 2:
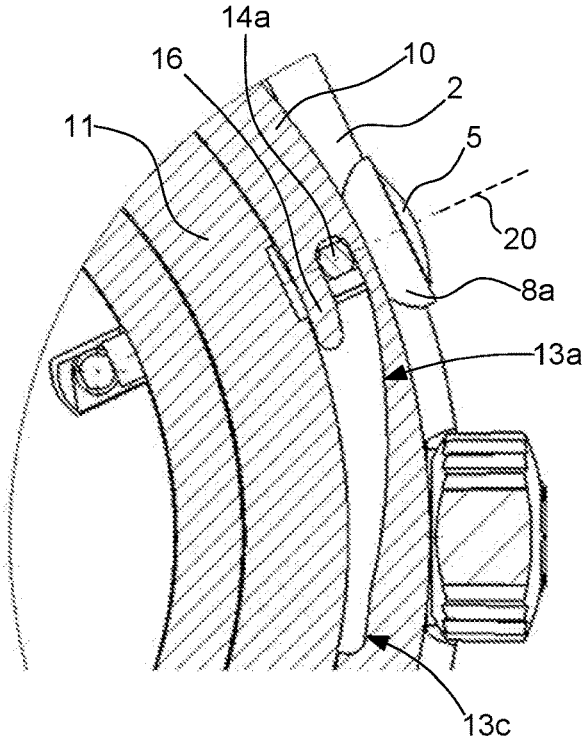
Figure 3:
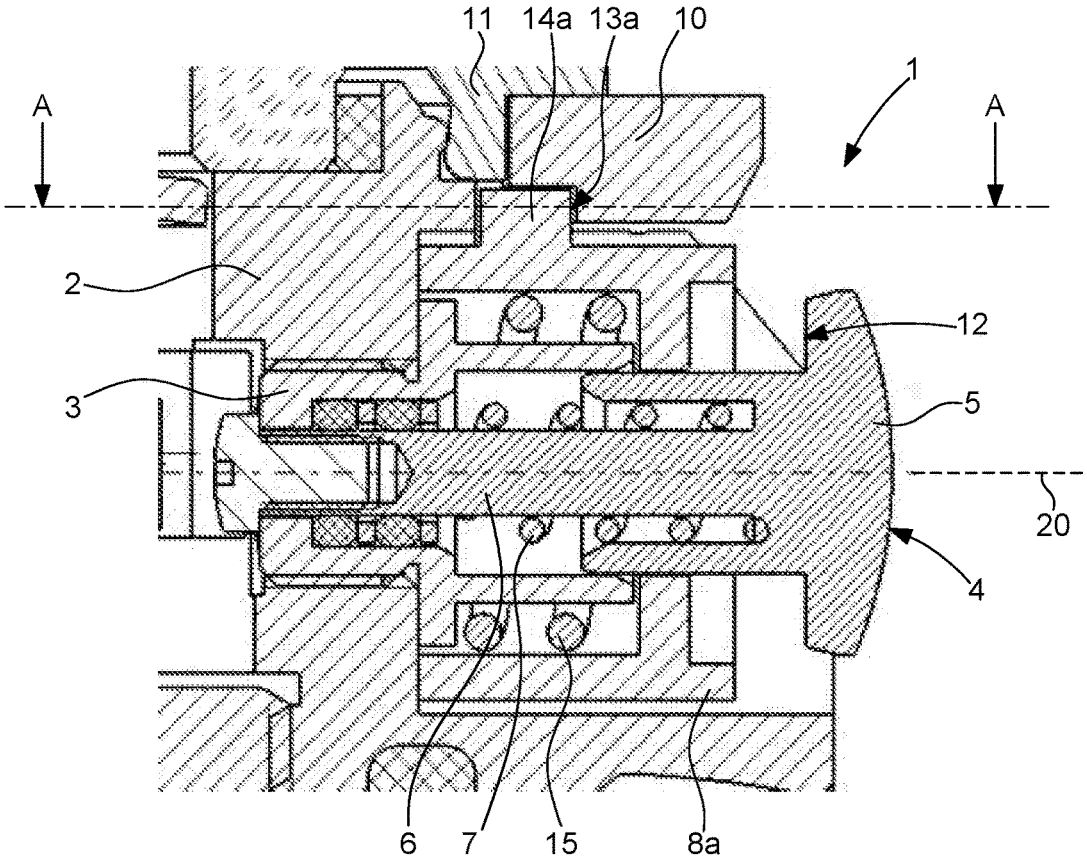
FIGS. 3 and 4 are cross-sectional views, similar to those in FIGS. 1 and 2, in which the locking device is in its unlocking position.

A first embodiment of the invention is described below with reference to FIGS. 1 to 4. The figures represent partial views in cross section of a timepiece showing a push-button arranged in the case middle 2 of the case 1 and its locking device. The push-button forms in particular a control means for a chronograph mechanism. This push-button is composed of a pendant 3, screwed into a tapping that the case middle 2 contains, and a pusher 4 extending partially to the exterior of the timepiece in order for it to be capable of actuation by a user. The pusher 4 contains a head 5 and a rod 6 adapted to slide in an opening that the pendant 3 contains in an actuation axis 20 passing through the case middle in parallel to the general plane of the case. A first spring 7 seeks to maintain the pusher 4 in a distal position with reference to the case middle 2 (as represented in all the figures).

The timepiece contains a locking device comprising a blocking means 8 that is movable in a translational manner in the actuation axis 20. In a first embodiment depicted in FIGS. 1 to 4, the blocking means 8 is formed by a cylindrical sleeve 8*a* surrounding the pusher 4, this sleeve having an internal shoulder defining an abutment 12 for the head 5 of the pusher at least when the locking device is in its locking position.

The locking device also contains a control means 10 rotatably mounted with reference to the case middle 2, about an axis perpendicular to the general plane of the case 1, and thus perpendicular to the actuation axis 20. In general terms, the control means extends in the general plane of the case which is substantially parallel to the actuation axis, and it is arranged movably in this general plane between a first position and a second position corresponding respectively to the locking and unlocking positions of the locking device. Preferably, the control means 10 extends at least partially to the exterior of the case in such a way as to be capable of being easily actuated by a user. In the first embodiment depicted in FIGS. 1 to 4, the control means is a rotating ring 10 mounted between the case middle 2 and a bezel 11 that the case 1 contains.

The operation of the locking mechanism is now described in detail. The blocking means 8 has the ability to be displaced between a locking position represented in FIGS. 1 and 2 and an unlocking position represented in FIGS. 3 and 4. In the locking position, an abutment 12 of the blocking means 8 is positioned directly beneath the head 5 of the pusher 4 in order to substantially block the pusher 4 in translation and, in so doing, to prevent its actuation in order to perform the function associated with this pusher. In the unlocking position, the blocking means has been translated in the actuation axis in such a way as to release the pusher 4 in translation and to make it operational.

The displacement of the blocking means between its locking position and its unlocking position is controlled by the control means 10 which is linked kinematically to the blocking means 8. In order to do this, the control means 10 contains driving means cooperating with a follower means that the blocking means 8 contains. In the first embodiment, the driving means is formed by a cam 13*a* and an elastic return means 15, whereas the follower means is formed by a pin 14*a* coming into contact with the cam 13*a* and playing the role of a cam follower. The elastic return means 15 (in particular a helicoidal spring) permits the pin 14*a* to be maintained in contact with the cam 13*a* in the two directions of actuation of the control means. In the variant represented here, the cam 13*a* is defined by a lateral surface of an internal recess of the rotating ring 10, of which the profile exhibits a steady radial variation between two angular positions defining respectively a first position and a second position corresponding to the locking and unlocking positions.

In order to ensure that the locking and unlocking positions are stable positions, the locking device preferably contains a means of positioning arranged in order to maintain the control means in place in the above-mentioned first and second positions. In particular, the control means may be pivotably mounted with low friction, which may be sufficient to ensure that it is maintained in said first and second positions. The means of positioning depicted in the figures is formed primarily by the substantially zero slope of the cam 13*a* at its two extremities 13*c*, which define respectively said first and second positions. The slope of the cam is considered in a circular frame of reference, such that a zero slope corresponds to a circular path.

The positioning may also be realized or reinforced by the fact that the pin 14*a* is held radially in its two extreme radial positions, corresponding to the first and second positions, on the one hand by an internal tongue 16 formed in the rotating ring 10 and on the other hand by a bearing surface defined by the case middle 2. The slope of the cam in the central zone causes a relatively rapid displacement of the blocking means in response to a small angular displacement of the control means, whereas the substantially zero slope at the extremities 13*c* of the cam prevents the transmission of a torque from the follower element towards the control means. A rotation of the rotating ring through about thirty degrees thus makes it possible to displace the blocking means in both directions between its locking and unlocking positions.

It is also possible to propose that the means of positioning the control means contains pressure points that must be passed just before reaching said first and second positions, and thus either the locking position or the unlocking position. This permits the two functional positions of the control means to be further secured. The passage of a pressure point in addition provides the user with a tactile indication of the locking or the unlocking.

FIGS. 5 to 9 depict a second embodiment which contains alternative solutions to those depicted in the first embodiment. Since these variants are independent one from the other, they may be combined together. It is obvious that the invention is not restricted to the two depicted embodiments, but that it also covers the combinations of the different alternatives and their equivalents.

In a first variant of the second embodiment, the blocking means is a slider 8*b* adapted to slide in the direction of the actuation axis of the pusher in a radial slide 9 that the case middle contains. The slide 9 may exhibit a dovetail shape or any other suitable profile.

In a second variant, the control means 10 is formed directly by a rotating bezel 11 that the case contains or supports.

According to another variant, the cam is formed by a groove 13*b* housing the pin 14*a* at least partially and having substantially the width of the diameter of this pin. This configuration corresponds to a desmodromic control, for which the elastic return means of the driving means of the blocking means may be omitted in order to limit the dimensions of the locking device. It may nevertheless be interesting to retain a small elastic return means in this case in order to take up any free play between the component parts and to eliminate any small parasitic translations of the blocking means.

In an alternative manner to the two embodiments depicted in the figures, the cam may just as well be a protruding rib, and the follower means may be a slot machined into the blocking means and receiving the rib, the sliding of the rib in the slot causing the radial displacement of the locking means.

The locking device may also contain a visual means facilitating the recognition of the position of the blocking means. This visual means, typically a mark, may be situated on the control means or directly on the blocking means. In the depicted embodiments, the blocking means is concealed in the unlocking position whereas it is visible in the locking position. The visibility of the locking means, which may be reinforced by a bright colour, in this case is the visual means which permits its position to be known.

Figure 4:
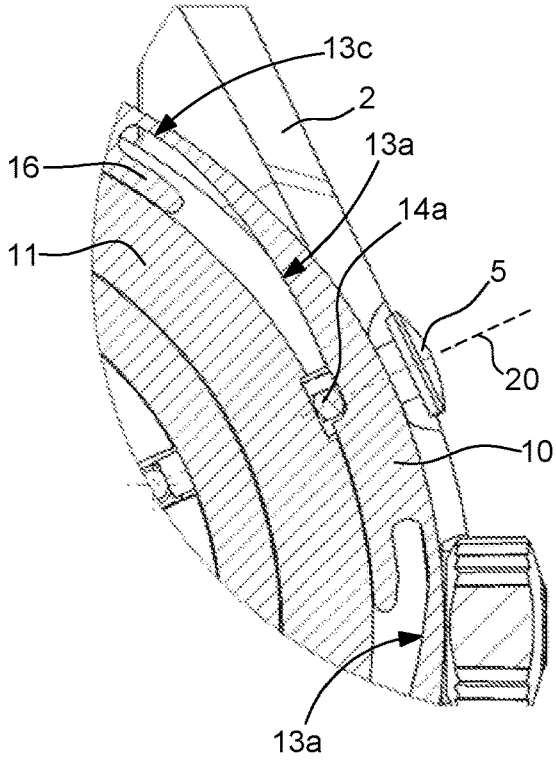
Figure 5:
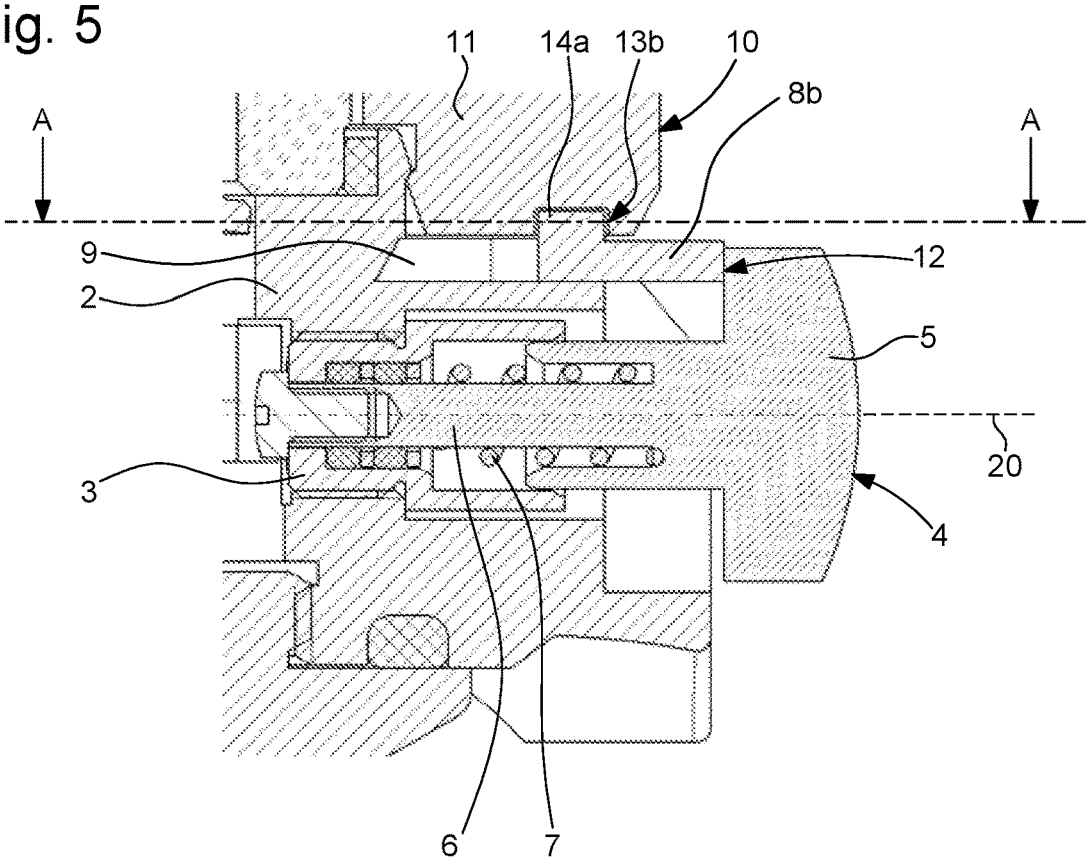
Figure 6:
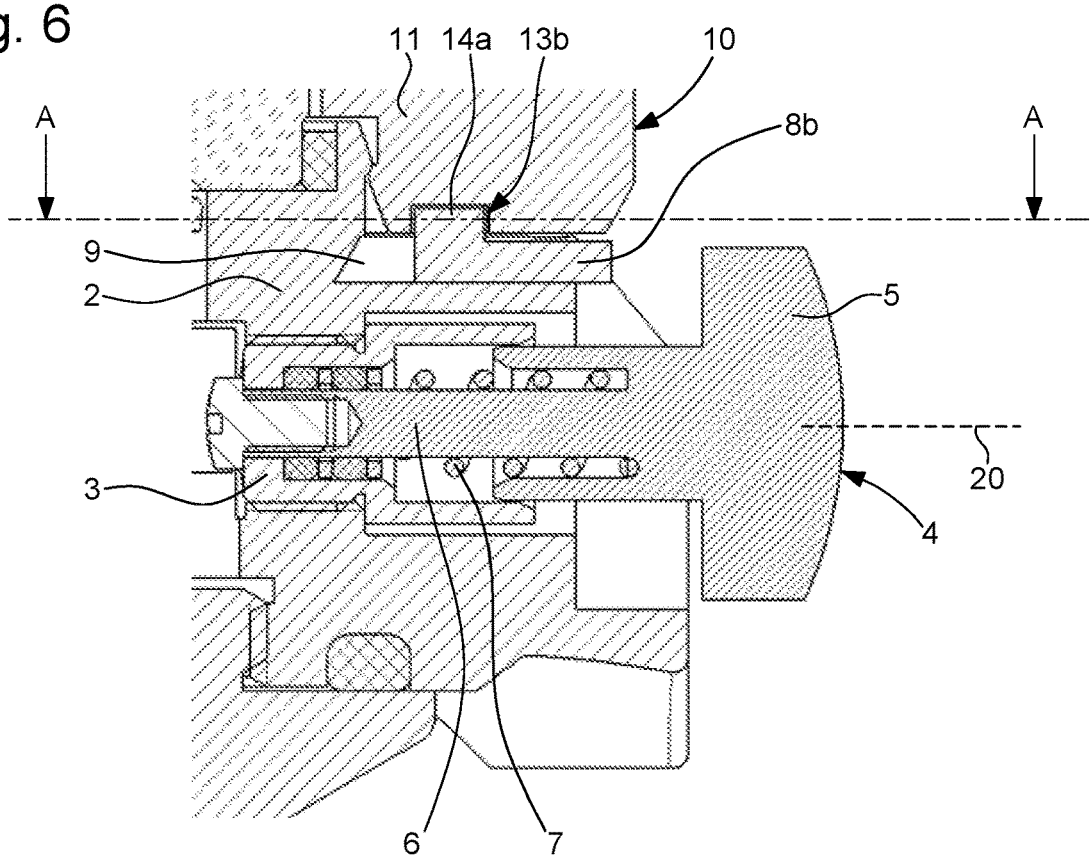
Figure 7:
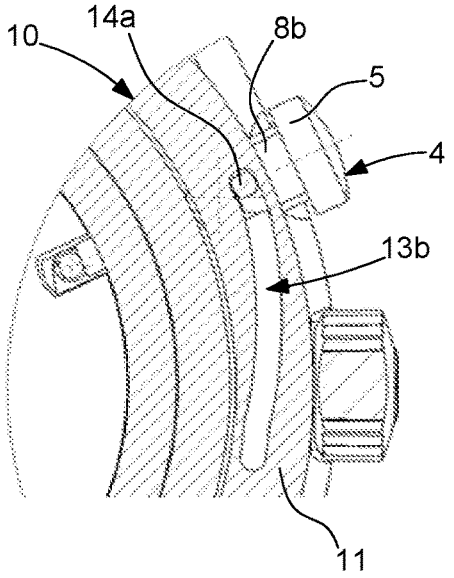
Figure 8:
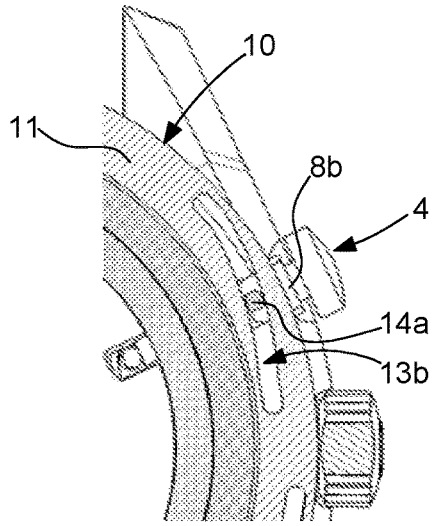
Figure 9:
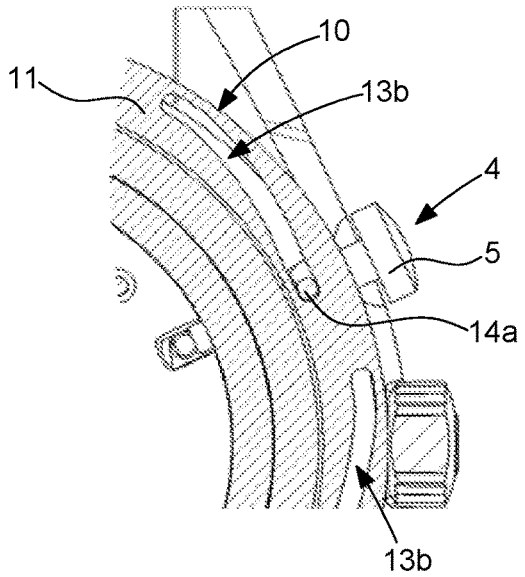

It will also be noted in FIGS. 4 and 9 that it is easy to make provision for the control means 10 to contain a plurality of grooves 13*b*, respectively a plurality of cams 13*a*, in order to lock a plurality of pushers simultaneously.

The different proposed solutions thus make it possible to produce locking devices for one or a plurality of pushers which are easier and more rapid to utilize for locking with a single movement. The fact that the blocking means may be entirely retracted into the case middle makes the locking device discreet. Furthermore, the actuation of a conventional pusher is not made less easy by the presence of the locking device when the latter is placed in the unlocking position. Finally, the fact of relocating the control means at the level of the bezel permits the dimensions of the pushers to be increased to all effects not at all with the arrangement of the locking device according to the invention, which permits a classic appearance to be retained for the watch case, which may appear to be virtually identical externally to a corresponding case without a suchlike locking device.

What is claimed is:

1. A timepiece comprising:

a case;

a pusher mounted in a case middle of the case; and a locking device adapted to lock the pusher, the pusher being configured to undergo a translation along an axis of actuation of the pusher, the locking device containing a blocking means and a control means arranged to control displacement of the blocking means between a locking position and an unlocking position, in which positions the pusher is respectively blocked and free in translation, the control means extending in a general plane parallel to said actuation axis and being arranged movably in the general plane between a first position and a second position which correspond respectively to the locking and unlocking positions for the blocking means driven by the control means, wherein said blocking means is arranged movably in a translational manner along the actuation axis and said blocking means is configured to be displaced by the control means along the actuation axis between said locking position, where the blocking means forms an axial abutment for the pusher, and said unlocking position set back from the locking position, the control means containing means for driving the blocking means in the actuation axis.

2. The timepiece according to claim 1, wherein the driving means contains a cam for the radial positioning of the blocking means, the cam cooperating with a follower means that the blocking means contains.

3. The timepiece according to claim 2, wherein the driving means contains an elastic return means configured to maintain the follower means in contact with the cam.

4. The timepiece according to claim 2, wherein the cam exhibits a groove and the follower means is a pin inserted into the groove.

5. The timepiece according to claim 2, wherein the cam is formed by a rib and the follower means is a slot.

6. The timepiece according to claim 1, wherein the case contains or supports a bezel, wherein the control means is formed by a ring which is rotatably mounted between the case middle and the bezel about an axis that is perpendicular to said actuation axis.

7. The timepiece according to claim 1, wherein the case contains or supports a bezel, wherein said control means is formed by the bezel which is rotatably arranged.

8. The timepiece according to claim 2, wherein the blocking means is a cylindrical sleeve surrounding the pusher and configured to be displaced along said actuation axis of the pusher between said locking and unlocking positions.

9. The timepiece according to claim 2, wherein the blocking means is a slider which is arranged slidably in said actuation axis of the pusher between said locking and unlocking positions.

10. The timepiece according to claim 1, wherein the pusher contains a head and the blocking means is adapted to be positioned in order to lock the pusher bearing against the head.

11. The timepiece according to claim 1, wherein the locking device contains a visual means facilitating the recognition of the position of the blocking means.

12. The timepiece according to claim 1, wherein the locking device contains a means of positioning arranged in order to maintain the control means in one or other of the first and second positions.

13. The timepiece according to claim 1, wherein, in the unlocked position, the blocking means is spaced apart from the pusher.

14. The timepiece according to claim 1, wherein, in the locked position, the pusher extending outside of the case.

15. A timepiece comprising:

a case;

a pusher mounted in a case middle of the case; and a locking device adapted to lock the pusher, the pusher being configured to undergo a translation along an axis of actuation of the pusher by a user, the locking device containing a cylindrical sleeve surrounding the pusher and a ring which is rotatably mounted between the case middle and the bezel, the ring being arranged to control displacement of the cylindrical sleeve between a locking position and an unlocking position, in which positions the pusher is respectively blocked and free in translation, the ring extending in a general plane parallel to said actuation axis and being arranged movably in the general plane between a first position and a second position which correspond respectively to the locking and unlocking positions for the cylindrical sleeve driven by the ring, wherein said cylindrical sleeve is arranged movably in a translational manner along the actuation axis and said cylindrical sleeve is configured to be displaced by the ring along the actuation axis between said locking position, where the cylindrical sleeve forms an axial abutment for the pusher, and said unlocking position set back from the locking position, the ring containing a cam for driving the cylindrical sleeve in the actuation axis.

16. A timepiece comprising:

a case;

a pusher mounted in a case middle of the case; and a locking device adapted to lock the pusher, the pusher being configured to undergo a translation along an axis of actuation of the pusher by a user, the locking device containing a slider surrounding the pusher and a bezel which is rotatably mounted, the bezel being arranged to control displacement of the slider between a locking position and an unlocking position, in which positions the pusher is respectively blocked and free in translation, the bezel extending in a general plane parallel to said actuation axis and being arranged movably in the general plane between a first position and a second position which correspond respectively to the locking and unlocking positions for the slider driven by the bezel, wherein said slider is arranged movably in a translational manner along the actuation axis and said slider is configured to be displaced by the bezel along the actuation axis between said locking position, where the slider forms an axial abutment for the pusher, and said unlocking position set back from the locking position, the bezel containing a cam for driving the slider in the actuation axis.

* * * * *